US009404299B2

(12) United States Patent
Braden et al.

(10) Patent No.: US 9,404,299 B2
(45) Date of Patent: Aug. 2, 2016

(54) HOME APPLIANCE WITH ADJUSTABLE HINGES

(75) Inventors: Ben Braden, Lafollette, TN (US); Rose Marie Parker, Caryville, TN (US); Timothy Russell, Jacksboro, TN (US)

(73) Assignee: BSH Home Appliances Corporation, Irvine, CA (US)

( * ) Notice: Subject to any disclaimer, the term of this patent is extended or adjusted under 35 U.S.C. 154(b) by 1128 days.

(21) Appl. No.: 13/461,925

(22) Filed: May 2, 2012

(65) Prior Publication Data

US 2013/0291853 A1 Nov. 7, 2013

(51) Int. Cl.

| | |
|---|---|
| ***E05D 7/04*** | (2006.01) |
| ***F24C 15/02*** | (2006.01) |
| ***E05D 7/12*** | (2006.01) |
| ***E05F 1/12*** | (2006.01) |

(52) U.S. Cl.

CPC ..... *E05D 7/04* (2013.01); *E05D 7/0423* (2013.01); *E05D 7/12* (2013.01); *E05F 1/1276* (2013.01); *F24C 15/02* (2013.01); *E05Y 2900/308* (2013.01); *Y10T 16/53253* (2015.01)

(58) Field of Classification Search

CPC ..... E05D 7/04; E05D 7/0423; E05D 7/12; F24C 15/02; F24C 15/023; E05F 1/1276; E05Y 2900/308; Y10T 16/532; Y10T 16/5324; Y10T 16/53253; Y10T 16/53257; Y10T 16/5383; Y10T 16/53834; A47B 88/0055

USPC ..... 16/286, 235, 242, 245, 246, 289; 126/19 R, 194; 312/326, 328

See application file for complete search history.

(56) References Cited

U.S. PATENT DOCUMENTS

| | | | | |
|---|---|---|---|---|
| 2,757,663 | A * | 8/1956 | Pearce | F24C 15/023 126/194 |
| 3,045,663 | A * | 7/1962 | McDonald | F24C 15/023 126/190 |
| 3,092,097 | A * | 6/1963 | Moss | F24C 15/023 126/194 |
| 3,132,640 | A * | 5/1964 | Chisholm | F24C 15/023 126/194 |
| 4,021,968 | A * | 5/1977 | Kendall | E05F 1/1075 126/191 |
| 4,665,892 | A * | 5/1987 | Spargo | F24C 15/023 126/194 |
| 7,150,071 | B2 | 12/2006 | Collene | |
| 8,911,036 | B2 * | 12/2014 | Elkasevic | E05F 5/08 312/328 |
| 8,985,717 | B2 * | 3/2015 | Marzorati | E05F 1/1261 16/286 |
| 9,074,404 | B2 * | 7/2015 | Delozier | E06B 5/00 |
| 9,145,722 | B2 * | 9/2015 | Gherardi | E05D 11/08 |
| 2010/0212112 | A1 | 8/2010 | Steurer et al. | |
| 2010/0251521 | A1 * | 10/2010 | Donoho | E05D 11/06 16/343 |
| 2013/0214663 | A1 * | 8/2013 | Marzorati | E05F 1/1261 312/400 |

* cited by examiner

*Primary Examiner* — William Miller

(74) *Attorney, Agent, or Firm* — Michael Tschupp; Andre Pallapies

(57) ABSTRACT

A home appliance having an adjustable door and including an appliance body defining a cavity therein, defining an access opening to the cavity and carrying the door, with the door being movable between a generally vertical covering relationship with the access opening and a generally horizontal open relationship with the access opening; and at least one hinge assembly operatively associated with the door, the hinge assembly including an adjustable hinge receiver and a claw mounted to the hinge receiver and the door to extend therebetween, the hinge receiver including an adjustment assembly operatively connected to the claw for at least one of raising the door and lowering the door with respect to the appliance body, the adjustment assembly including a user-accessible adjustment member, wherein the adjustment member and the claw are in general vertical alignment and the adjustment member is disposed above the claw.

15 Claims, 5 Drawing Sheets

HOME APPLIANCE WITH ADJUSTABLE HINGES

BACKGROUND OF THE INVENTION

The present invention relates broadly to home appliances having adjustable structural features, and, more particularly, to a range having an adjustable door while providing convenient access to the adjustment apparatus.

As is generally known, ranges that are used in cooking typically include an oven chamber for roasting, broiling or baking. The oven chamber in modern ovens is covered by a movable door. The door is movable between an open position for range access and a closed position for cooking and pyrolytic cleaning. Such movement is facilitated by a hinge including a hinge claw that extends from the door to the range body. The hinge claw must be supported by the range body, and this is accomplished by a hinge receiver that is mounted within the range body.

Often, the door over the oven is not the only door on the range, and door alignment becomes a factor in the overall appearance of the range. The range body may include cavities other then the oven, such as a second oven with a door, a steamer compartment with a door, or an open cavity containing a warming drawer. Even in a single-door range, there may be cabinet drawers that are located sufficiently close to the oven door to look unsightly if the top portions of the drawers are not aligned with the door. Therefore, many oven doors are made adjustable in a vertical direction for alignment of the door with an adjacent structure. The more similar the structures the more visually important is the adjustability. The hinge receivers facilitate that adjustability.

Hinge receivers can include an adjustment mechanism that enables adjustment of the position of the door relative to the range body. These adjustment mechanisms are generally located in the hinge receiver vertically below where the hinge receiver receives and supports the hinge claw. Positioning of the adjustment mechanism in this location requires space below the area where the hinge claw is received and this limits the size and position of the door. Further, such adjustment mechanisms are difficult to access to perform any door height adjustment. Other ranges, such as those with tall doors and visible feet may not have the room for traditional adjustable hinges. Accordingly, there exists a need for hinges that fit within the allotted space of the range and are accessible in a more straightforward manner than past hinges.

SUMMARY OF THE INVENTION

Accordingly, the present invention is intended to provide a hinge that provides space below the claw receiving area of a range, such as the range discussed above with taller doors and visible feet.

The present invention is further intended to provide a hinge having an adjustment feature with operational access available to a user when the door is open yet mounted to the range.

To those ends, the present invention is directed to a home appliance having an adjustable door. The home appliance includes an appliance body defining a cavity therein, defining an access opening to the cavity and carrying the door, with the door being movable between a generally vertical covering relationship with the access opening and a generally horizontal open relationship with the access opening. Further provided is at least one hinge assembly operatively associated with the door. The hinge assembly includes an adjustable hinge receiver and a claw mounted to both the hinge receiver and the door to extend therebetween. The hinge receiver includes an adjustment assembly operatively connected to the claw for at least one of raising the door and lowering the door with respect to the appliance body. The adjustment assembly also includes a user-accessible adjustment member, wherein the adjustment member and the claw are in general vertical alignment and the adjustment member is disposed above the claw.

Preferably, the hinge assembly includes an outer pocket and an inner pocket, wherein the outer pocket is mounted to the range body and the inner pocket is mounted within the outer pocket for movement relative to the outer pocket. Further, the claw is preferably fitted to the inner pocket for movement therewith. The outer pocket may be formed with a claw slot for projection of the claw therethrough for free movement of the claw within the slot relative to the outer pocket.

It is preferred that the adjustment assembly is mounted to the inner pocket with the adjustment member projecting through an adjustment member opening in the outer pocket, wherein the adjustment member opening and the claw slot are in generally vertical alignment with the adjustment member opening being disposed above the claw slot. Preferably, the adjustment member is a screw and the adjustment assembly includes a traveling riser and a base pin with the traveling riser being threadedly attached to the screw and in abutment the base pin. The inner pocket may further include a traveling plate disposed vertically above and in abutment with the traveling riser for generally vertical movement therewith responsive to rotation of the adjustment screw.

Preferably, the claw is mounted to the hinge receiver assembly using at least one claw pin mounted to the inner pocket for movement therewith. In addition, the outer pocket may include slots formed in sidewalls thereof with the at least one claw pin disposed slidably therein.

The present invention is also directed to a range for cooking use. To that and previously stated ends, a range having an adjustable oven door includes a body defining an oven cavity therein and an access opening to the oven cavity with the oven door being movable between a generally horizontal open relationship with the access opening and a generally vertical covering relationship with the access opening. Further, the present invention includes at least one hinge assembly operatively associated with the oven door. The hinge assembly includes an adjustable hinge receiver and a claw mounted to the oven door and the hinge receiver to extend therebetween. The hinge receiver also includes an adjustment assembly operatively connected to the claw for at least one of raising the oven door and lowering the oven door. The adjustment assembly includes a user-accessible adjustment member, wherein the adjustment member and the claw are in general vertical alignment and the adjustment member is disposed above the claw.

Preferably, the hinge assembly includes an outer pocket and an inner pocket, wherein the outer pocket is mounted to the range body and the inner pocket is mounted within the outer pocket for movement relative to the outer pocket. Further, the outer pocket may be formed with a claw slot for projection of the claw therethrough for free movement of the claw within the slot relative to the outer pocket It is preferred that the adjustment assembly is mounted to the inner pocket with the adjustment member projecting through an adjustment member opening in the outer pocket, with the adjustment member opening and the claw slot in generally vertical alignment and the adjustment member opening is disposed above the claw slot.

It is preferred that the adjustment member is a screw and the adjustment assembly includes a traveling riser and a base pin with the traveling riser being threadedly attached to the screw and in abutment the base pin. Preferably, the inner pocket includes a traveling plate disposed vertically above and in abutment with the traveling riser for generally vertical movement therewith responsive to rotation of the adjustment screw.

Preferably, the claw is mounted to the hinge receiver assembly using at least one claw pin mounted to the inner pocket for movement therewith. In addition, the outer pocket includes slots formed in sidewalls thereof with the at least one claw pin disposed slidably therein.

DESCRIPTION OF THE PREFERRED EMBODIMENT

Figure 1:
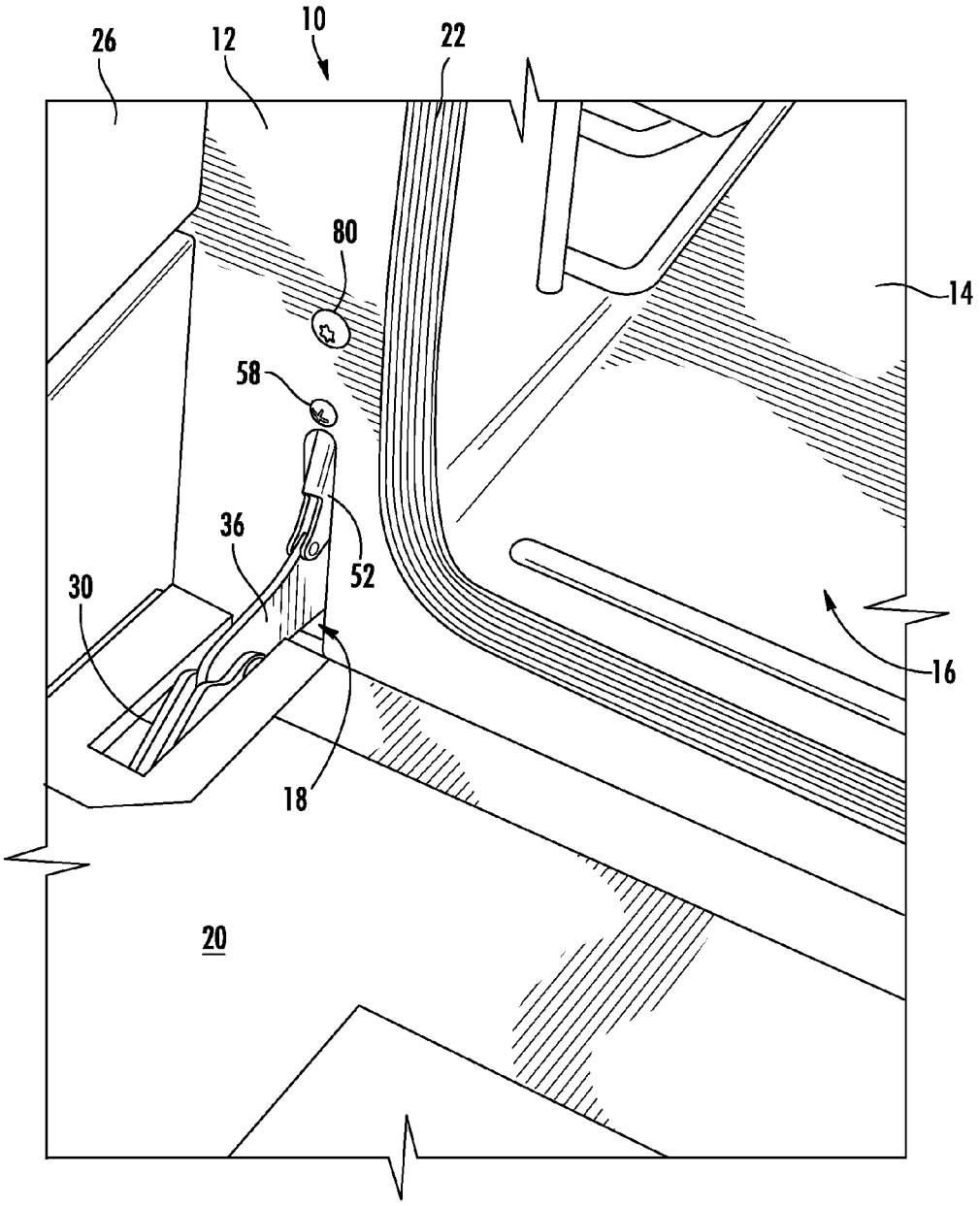
FIG. 1 is a perspective view of a home appliance having an adjustable hinge according to one preferred embodiment of the present invention.

Turning now to the drawings and more particularly to FIG. 1, a household appliance in the form of a range for cooking is illustrated generally 10 and includes a range body 12 having an oven 14 disposed therein. The body 12 further defines an access opening 16 for user access to the oven 14. As will be explained in greater detail presently, a slot 18 is formed in the range body 12 adjacent the access opening 16 for use as a hinge opening to allow a portion of a hinge assembly to project therethrough. A generally planar door 20 is mounted to the range body 12 for movement between an open relationship with the access opening 16, as seen in FIG. 1, and a closed relationship (not shown) with the access opening 16. A gasket 22 surrounds the access opening 16 to help contain the heat within the oven during cooking and self-cleaning or pyrolysis.

A second door 26 is provided adjacent the first door 20 on the range body 12. The second door 26 may cover access to a steamer, a second oven, a warming drawer or the like. According to the present invention, one or both doors are be mounted using an adjustable hinge assembly that will allow the raising and lowering of one or both doors in relation to one another so that the tops of both the doors are even, giving a clean, professional installed look. In some ranges, the second door 26 may be absent and the first door 20 may be aligned with a cabinet structure without departing from the spirit and scope of the present invention.

Figure 2:
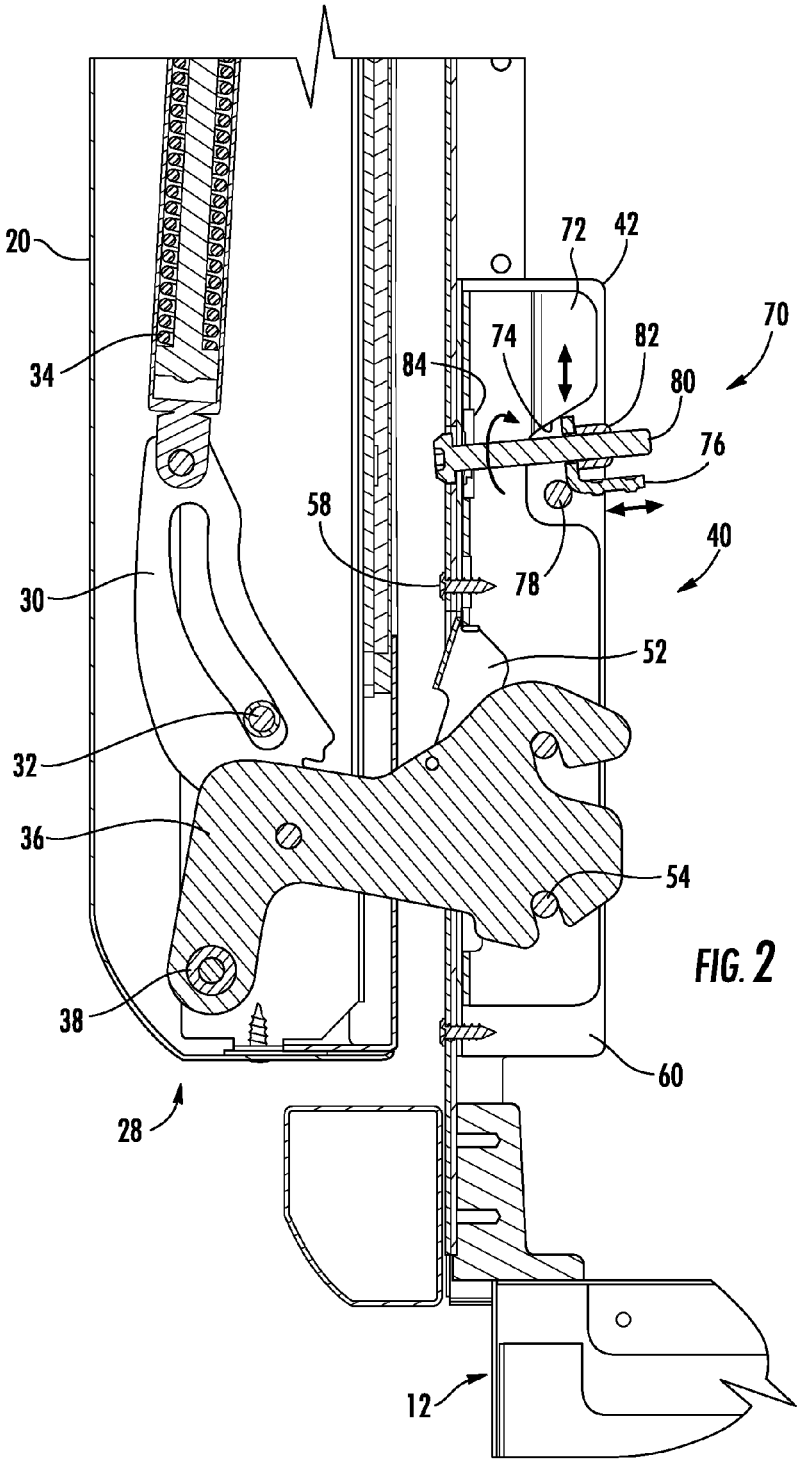
FIG. 2 is a side cutaway view of the oven door and adjustable hinge assembly illustrated in FIG. 1.

With reference to FIGS. 1 and 2, and initially to FIG. 2, a hinge assembly according to one preferred embodiment of the present invention is illustrated generally at 28. FIG. 1 illustrates the relationship between externally visible components of the hinge assembly 28 and the door 20 as seen from outside the range 12 with the door 20 open. The cutaway view of FIG. 2 provides a more detailed version of the hinge assembly 28. Part of the hinge assembly 28 resides in the door 20 and the other part of the hinge assembly 28 resides within the range body 12 with both portions being co-joined by a claw 36 and a cam 30. The cam 30 is pivotably mounted to a spring assembly 34 and a cam follower 32. As seen in FIG. 1, the cam 30 includes two identical portions arranged side by side in a mated relationship with a portion of the claw 36 extending therebetween. The cam 30 and the spring assembly 34 are provided to bias the door into a closed position after a certain predetermined amount of angular movement from the open position to the closed position. A claw brace 52 is attached to the claw 36 adjacent the claw slot 18 for stabilizing the claw 36. FIG. 1 shows the claw brace 52 in a locked state. The claw braces 52 must be rotated out horizontally to be able to remove the door 20. The claw 36 is a generally L-shaped member being pivotally mounted to the door 20 at a claw pivot pin 38 mounted to the door 20 near a base thereof when the door is in a closed position as seen in FIG. 2. The claw 36 projects linearly away from the range body 12 with the crook of the L facing downwardly and directing the lower portion of the L to the claw pivot pin 38.

Figure 3:
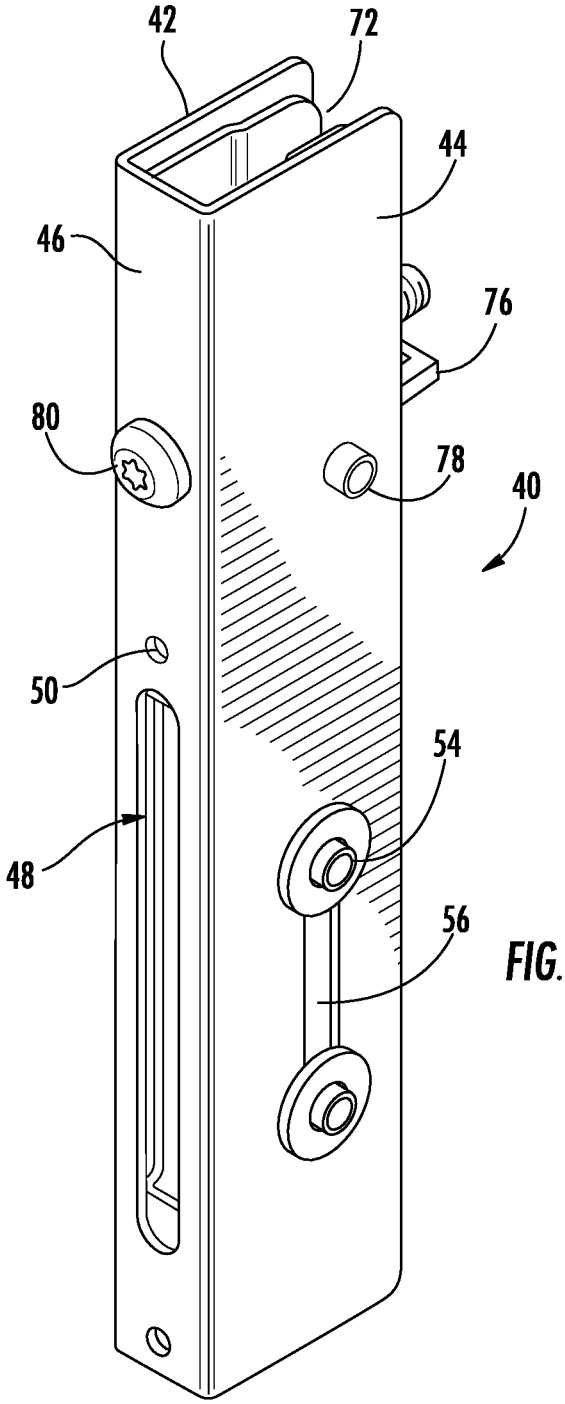
FIG. 3 is a perspective view of a hinge receiver assembly illustrated in FIG. 2.

The claw 36 projects inwardly into the range body 12 for mating with a hinge receiver illustrated generally at 40. The hinge receiver 40 is seen in FIGS. 2, 3, and 5-7. With reference to FIG. 3, the hinge receiver assembly 40 includes an outer pocket 42 formed as a generally narrow U-shaped channel from two side walls 44 joined to a front wall 46. The channel forming the outer pocket 42 is much taller than it is wide. A claw slot 48 is formed vertically along the front wall 46 at a lower portion thereof. As explained in greater detail hereinafter, claw support pins 54 extend in a spaced, parallel relationship through one side wall of the outer pocket 42 for mounting the claw 36 within the hinge receiver assembly 40. A slot 56 is formed in one of the sidewalls 44 to allow projection of claw support pins therethrough and, as will be seen, to limit the travel of claw support pins 54 during door adjustment. Two mounting holes 50 are formed in the front wall 46 for receiving respective screws 58, as seen in FIG. 1 and FIG. 2, to assist in mounting the hinge receiver assembly 40 to the range body 12.

Figure 4:
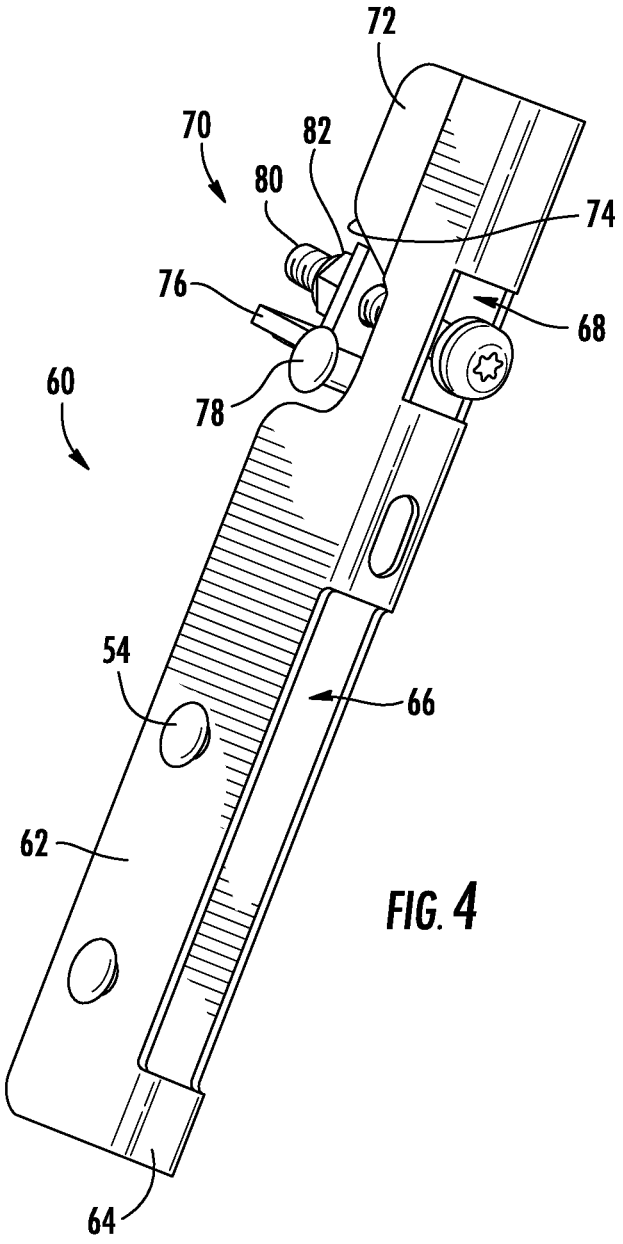
FIG. 4 is a perspective view of the inner pocket of the hinge receiver illustrated in FIG. 3.
Figure 7:
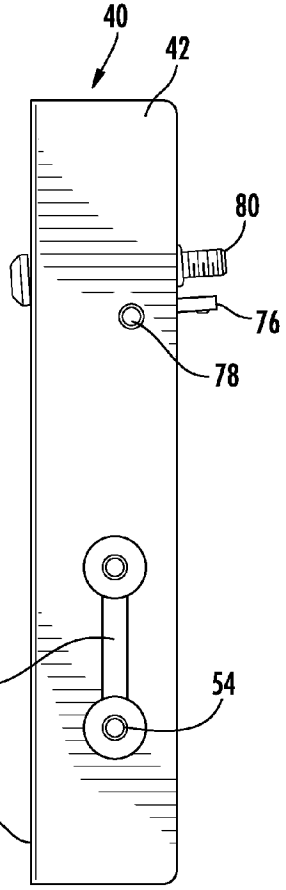
FIG. 7 is a side view of the hinge receiver assembly illustrated in FIG. 5.

As seen in FIGS. 2 and 4, an inner pocket 60 is provided for movement within the outer pocket 42. The inner pocket 60 is formed from two sidewalls 62 joined by a front wall 64 for fitment with the outer pocket 42 The inner pocket 60 includes a claw slot 66 for accommodating the claw 36 projecting outwardly therefrom as seen in FIG. 2. With reference to FIG. 4, a generally rectangular opening 68 is provided above the claw slot and for passage of an adjustment member 80 therethrough. A traveling plate 72 is formed integrally with the sidewalls 62 which will be used with the adjustment assembly as will be described in greater detail hereinafter. A pair of claw support pins 54 project through the sidewalls 62 adjacent the claw slot 66 for mounting the claw 36 thereto. The claw 36 mounting relationship with the claw pins 54 is best seen in FIG. 2.

Figure 6:
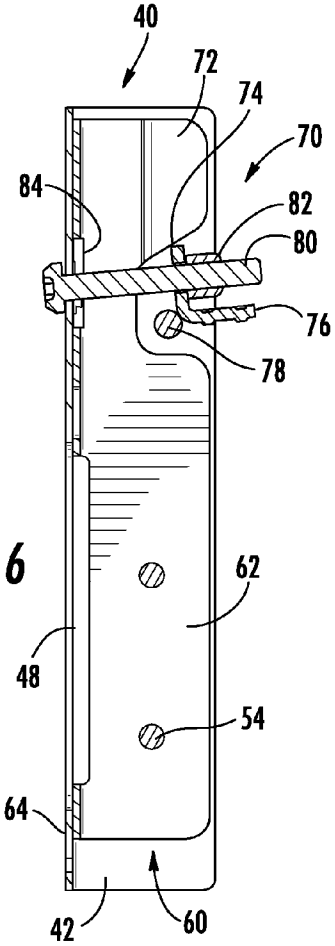
FIG. 6 is a cutaway view of the hinge receiver assembly taken through line 6-6 of FIG. 5.
Figure 5:
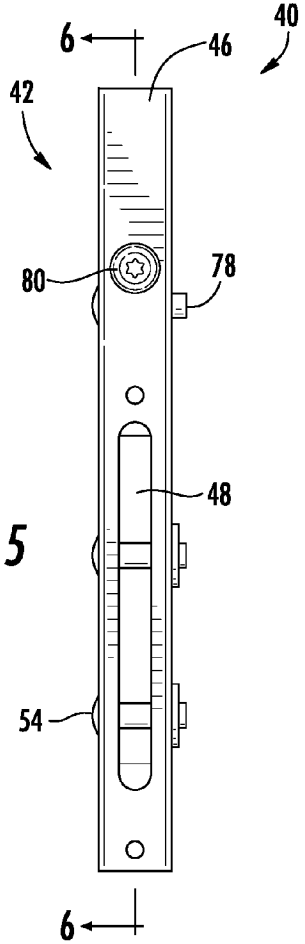
FIG. 5 is a front view of the hinge receiver assembly illustrated in FIG. 3.

With reference to FIGS. 2 and 4-7, the adjustment assembly is illustrated generally at 70. As seen in FIGS. 2 and 6, the adjustment assembly 70 includes the adjustment member 80 that is formed as an elongate screw rotatably mounted to the inner pocket 60 with a lock washer 84 that holds the adjustment member 80 in place while allowing rotation thereof. As seen in FIGS. 1 and 2, the adjustment member projects through the inner pocket 60, the outer pocket 42 and the range body 12 for adjustable access by a user.

The adjustment member 80 is threadedly engaged with a generally L-shaped riser 76 that rests on a riser pin 78. The riser pin 78 is mounted to and extends through the sidewalls 44 of the outer pocket 42, as seen in FIG. 3. Turning again to FIG. 2 and FIG. 6, the crook of the L of the L-shaped member 76 rides on the riser pin 78 while an upstanding portion includes a threaded aperture which is threadedly engaged with the adjustment member 80. An upper portion of the riser 76 is in abutment with a contact surface 74 of the traveling plate 72. A lock nut 82 is threaded onto the adjustment member 80 to limit travel of the riser 76 when the adjustment member 80 is rotated.

As can be seen from the above, the claw 36 is mounted to the hinge receiver assembly 40 and is carried on pins 54 that are mounted to the inner pocket 60 for movement therewith. The claw pins 54 project through a slot 56 in the outer pocket 42 to limit movement of the claw pins 54 and thereby limit movement of the claw 36. The adjustment assembly 70 causes movement of the traveling plate 72 and, accordingly, the inner pocket 60 to carry the claw 36, and the door 20, in vertical movement, either upwardly or downwardly.

In operation, the door 20 may be adjusted with the door 20 open yet not removed from the range 12. The range of adjustment available to align the door 20 with other structures as discussed above, is on the order of ¼ inch, i.e., ⅛ inch in either direction, up or down. In order to move the inner pocket 60 and the claw 36, a proper tool is engaged with the rotatable adjustment member and turned, causing the adjustment member 80 to rotate. A Torx connection is illustrated, but the head of the adjustment member 80 may have any number of configurations, each operable with equal success.

If the adjustment member 80 is rotated clockwise, threaded engagement with the riser 76 causes the riser 76 to retract and move closer to the door 20. This causes the riser 76 to move upwardly against the riser pin 78 and, due to contact with the inclined traveling plate 72, causes the traveling plate 72 to rise and the remainder of the inner pocket 60 rises with the integral traveling plate 72. The claw support pins 54 that are firmly mounted to the inner pocket 60 also rise, thereby causing the claw 36 to rise, thereby causing the door 20 to rise. General movement of the adjustment member 80, the riser 76 and the traveling plate 72 are illustrated in FIG. 2 with arrows.

If the adjustment member 80 is rotated in an anti-clockwise manner, the riser 76 is driven outwardly and moves downwardly along the riser pin 78 thereby allowing the weight of the traveling plate 72, inner pocket 60, claw pins 54, claw 36 and door 20 to drive the door 20 downwardly. As previously stated, movement of the riser 76 is limited to a movement sufficient to allow ⅛-inch up and ⅛ inch down adjustment of the door 20.

By the above, the present invention provides a home appliance, such as a range, having an adjustable door with an adjustment assembly that is operably accessible with the oven door attached to the range. Further, the adjustment portion of the hinge assembly is disposed above the claw for unobstructed accessibility once the door is opened. In this manner, the factory technician or oven installer can more easily and effectively make the door of the oven even with other oven or cabinet structures thereby enhancing the value and appearance of the entire range installation. Finally, by locating the adjustment assembly above the claw, additional space is available below the claw for other uses.

It will therefore be readily understood by those persons skilled in the art that the present invention is susceptible of a broad utility and application. While the present invention is described in all currently foreseeable embodiments, there may be other, unforeseeable embodiments and adaptations of the present invention, as well as variations, modifications and equivalent arrangements, that do not depart from the substance or scope of the present invention. The foregoing disclosure is not intended or to be construed to limit the present invention or otherwise to exclude such other embodiments, adaptations, variations, modifications and equivalent arrangements, the present invention being limited only by the claims appended hereto and the equivalents thereof.

What is claimed is:

1. A home appliance having an adjustable door, the home appliance comprising:

an appliance body defining a cavity therein, defining an access opening to the cavity and carrying the door, with the door being movable between a generally vertical covering relationship with the access opening and a generally horizontal open relationship with the access opening; and at least one hinge assembly operatively associated with the door, the hinge assembly including an adjustable hinge receiver and a claw mounted to the hinge receiver and the door to extend therebetween, the hinge receiver including an adjustment assembly operatively connected to the claw for at least one of raising the door and lowering the door with respect to the appliance body, the adjustment assembly including a user-accessible adjustment member, wherein the adjustment member and the claw are in general vertical alignment and the adjustment member is disposed above the claw;

wherein the hinge assembly includes an outer pocket and an inner pocket, wherein the outer pocket is mounted to the appliance body and the inner pocket is mounted within the outer pocket for movement relative to the outer pocket.

2. A home appliance according to claim 1, wherein the claw is fitted to the inner pocket for movement therewith.

3. A home appliance according to claim 2 wherein the outer pocket is formed with a claw slot for projection of the claw therethrough for free movement of the claw within the slot relative to the outer pocket.

4. A home appliance according to claim 3 wherein the adjustment assembly is mounted to the inner pocket with the adjustment member projecting through an adjustment member opening in the outer pocket, wherein the adjustment member opening and the claw slot are in generally vertical alignment with the adjustment member opening being disposed above the claw slot.

5. A home appliance according to claim 4 wherein the adjustment member is a screw and the adjustment assembly includes a traveling riser and a base pin with the traveling riser being threadedly attached to the screw and in abutment the base pin.

6. A home appliance according to claim 5 wherein the inner pocket includes a traveling plate disposed vertically above and in abutment with the traveling riser for generally vertical movement therewith responsive to rotation of the adjustment screw.

7. A home appliance according to claim 6 wherein the outer pocket includes slots formed in sidewalls thereof with the at least one claw pin disposed slidably therein.

8. A home appliance according to claim 1 wherein the claw is mounted to the hinge receiver assembly using at least one claw pin mounted to the inner pocket for movement therewith.

9. A range having an adjustable oven door comprising:

a body defining an oven cavity therein and an access opening to the oven cavity with the oven door being movable between a generally horizontal open relationship with the access opening and a generally vertical covering relationship with the access opening; and at least one hinge assembly operatively associated with the oven door, the hinge assembly including an adjustable hinge receiver and a claw mounted to the oven door and the hinge receiver to extend therebetween, the hinge receiver including an adjustment assembly operatively connected to the claw for at least one of raising the oven door and lowering the oven door, the adjustment assembly including a user-accessible adjustment member, wherein the adjustment member and the claw are in general vertical alignment and the adjustment member is disposed above the claw;

wherein the hinge assembly includes an outer pocket and an inner pocket, wherein the outer pocket is mounted to the range body and the inner pocket is mounted within the outer pocket for movement relative to the outer pocket.

10. A home appliance according to claim 9 wherein the outer pocket is formed with a claw slot for projection of the claw therethrough for free movement of the claw within the slot relative to the outer pocket.

11. A home appliance according to claim 10 wherein the adjustment assembly is mounted to the inner pocket with the adjustment member projecting through an adjustment member opening in the outer pocket, wherein the adjustment member opening and the claw slot are in generally vertical alignment with the adjustment member opening being disposed above the claw slot.

12. A range according to claim 9 wherein the adjustment member is a screw and the adjustment assembly includes a traveling riser and a base pin with the traveling riser being threadedly attached to the screw and in abutment the base pin.

13. A range according to claim 12 wherein the inner pocket includes a traveling plate disposed vertically above and in abutment with the traveling riser for generally vertical movement therewith responsive to rotation of the adjustment screw.

14. A range according to claim 12 wherein the outer pocket includes slots formed in sidewalls thereof with the at least one claw pin disposed slidably therein.

15. A range according to claim 9 wherein the claw is mounted to the hinge receiver assembly using at least one claw pin mounted to the inner pocket for movement therewith.

* * * * *